US011467527B2

(12) United States Patent
Itoh

(10) Patent No.: US 11,467,527 B2
(45) Date of Patent: Oct. 11, 2022

(54) IMAGE FORMING APPARATUS THAT CONTROLS TRANSMISSION OF DRIVING FORCE TO A DEVELOPING ROLLER BASED ON CURRENT THROUGH A MOTOR

(71) Applicant: Canon Kabushiki Kaisha, Tokyo (JP)

(72) Inventor: Masatoshi Itoh, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/335,392

(22) Filed: Jun. 1, 2021

(65) Prior Publication Data

US 2021/0373478 A1 Dec. 2, 2021

(30) Foreign Application Priority Data

Jun. 1, 2020 (JP) ..... JP2020-095729

(51) Int. Cl.
*G03G 15/00* (2006.01)

(52) U.S. Cl.
CPC ..... *G03G 15/757* (2013.01); *G03G 15/5008* (2013.01); *G03G 15/553* (2013.01)

(58) Field of Classification Search
CPC . G03G 15/757; G03G 15/5008; G03G 15/553
See application file for complete search history.

(56) References Cited

U.S. PATENT DOCUMENTS

2010/0266301 A1* 10/2010 Ohshika ..... G03G 15/5008 399/43
2015/0277354 A1* 10/2015 Fukamachi ..... G03G 15/757 399/12
2020/0073301 A1 3/2020 Sakai et al.

FOREIGN PATENT DOCUMENTS

JP H11-143218 A 5/1999
JP 2001109340 A 4/2001
JP 2006292868 A 10/2006
JP 2008-216631 A 9/2008
JP 2018-203424 A 12/2018
JP 2019-099282 A 6/2019

OTHER PUBLICATIONS

Extended European Search Report dated Oct. 7, 2021 in counterpart European Patent Appln. No. 21175211.8.
Notice of Allowance dated Jun. 24, 2022 by the Russian Patent Office in counterpart Russian Patent Appln. No. 2021115527.

* cited by examiner

*Primary Examiner* — Sandra Brase
(74) *Attorney, Agent, or Firm* — Venable LLP

(57) ABSTRACT

An image forming apparatus includes a developing roller, a motor, a motor control portion configured to control the motor, a drive switching unit configured to switch between transmission and non-transmission of the rotational driving force of the motor relative to the developing roller, a current detection portion configured to detect a current value of a current to the motor, and an acquisition unit configured to acquire information relating to a rotation amount of the developing roller. The acquisition unit is configured to acquire the information relating to the rotation amount of the developing roller on the basis of a transmission timing at which the rotational driving force is allowed to be transmitted to the developing roller by the drive switching unit and a non-transmission timing at which the rotational driving force is prevented from being transmitting to the developing roller by the drive switching unit.

15 Claims, 10 Drawing Sheets

IMAGE FORMING APPARATUS THAT CONTROLS TRANSMISSION OF DRIVING FORCE TO A DEVELOPING ROLLER BASED ON CURRENT THROUGH A MOTOR

BACKGROUND OF THE INVENTION

Field of the Invention

The present invention relates to an image forming apparatus, e.g., a copier, a printer, or a facsimile, including a motor.

Description of the Related Art

A brushless motor, a stepping motor or the like is used as a drive source of a rotating member of an image forming apparatus. In a developing roller, as described in Japanese Patent Application Publication No. 2006-292868, the unit for switching between drive and non-drive of the developing roller is disposed in a drive transmission path between the drive source and the developing roller, and the total rotation amount of the developing roller is reduced by starting the rotation of the developing roller immediately before image formation. In addition, there is proposed a configuration in Japanese Patent Application Publication No. 2001-109340 in which the service life of the developing roller is detected by disposing a sensor which detects the rotation of the developing roller in order to accurately measure the total rotation amount of the developing roller in the image forming apparatus.

SUMMARY OF THE INVENTION

In a case where the unit for switching between drive and non-drive of the developing roller is provided in the drive transmission path between the drive source and the developing roller as in Japanese Patent Application Publication No. 2006-292868, the rotation amount of the drive source does not match the rotation amount of the developing roller. Consequently, in a configuration in which a sensor which directly detects the rotation amount of the developing roller is not disposed, a problem arises in that it is difficult to accurately estimate the rotation amount of the developing roller. On the other hand, in a case where the sensor which detects the rotation of the developing roller is disposed as in Japanese Patent Application Publication No. 2001-109340, there is a concern that cost is increased due to addition of the sensor or the size of a product is increased due to necessity for space in which the sensor is disposed.

The present invention has been made in view of the above problem. An object thereof is to estimate, with higher accuracy, the rotation amount of a developing roller or information corresponding to the rotation amount in a space-saving manner at low cost.

In order to achieve the above object, an image forming apparatus in the present invention includes:

a developing roller;

a motor;

a motor control portion configured to control the motor;

a drive train configured to transmit a rotational driving force of the motor to the developing roller;

a drive switching unit for configured to switch between transmission and non-transmission of the rotational driving force of the motor relative to the developing roller by the drive train;

a current detection portion configured to detect a current value of a current flowing through the motor; and an acquisition unit configured to acquire information relating to a rotation amount of the developing roller, wherein the acquisition unit is configured to acquire the information relating to the rotation amount of the developing roller on the basis of (i) a transmission timing at which the rotational driving force is allowed to be transmitted to the developing roller by the drive switching unit and (ii) a non-transmission timing at which the rotational driving force is prevented from being transmitting to the developing roller by the drive switching unit, wherein the transmission timing and the non-transmission timing are acquired from a change of the current value detected by the current detection portion.

In order to achieve the above object, an image forming apparatus in the present invention includes:

a developing roller;

a motor;

a motor control portion configured to control the motor;

a drive train configured to transmit a rotational driving force of the motor to the developing roller;

a drive switching unit configured to switch between transmission and non-transmission of the rotational driving force of the motor relative to the developing roller by the drive train;

a current detection portion configured to detect a current value of a current flowing through the motor; and an acquisition unit configured to acquire information relating to a rotation amount of the developing roller, wherein the acquisition unit is configured to acquire the information relating to the rotation amount of the developing roller on the basis of (i) first information relating to a rotation of the motor acquired at a first timing and (ii) second information relating to the rotation of the motor acquired at a second timing, wherein the acquisition unit is configured to determine the first timing and the second timing on the basis of a change of the current value detected by the current detection portion.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Hereinbelow, Embodiment 1 of the present invention will be described based on FIGS. 1 to 7. Note that the present embodiment is only illustrative, and the present invention is not limited to these components.

Figure 1:
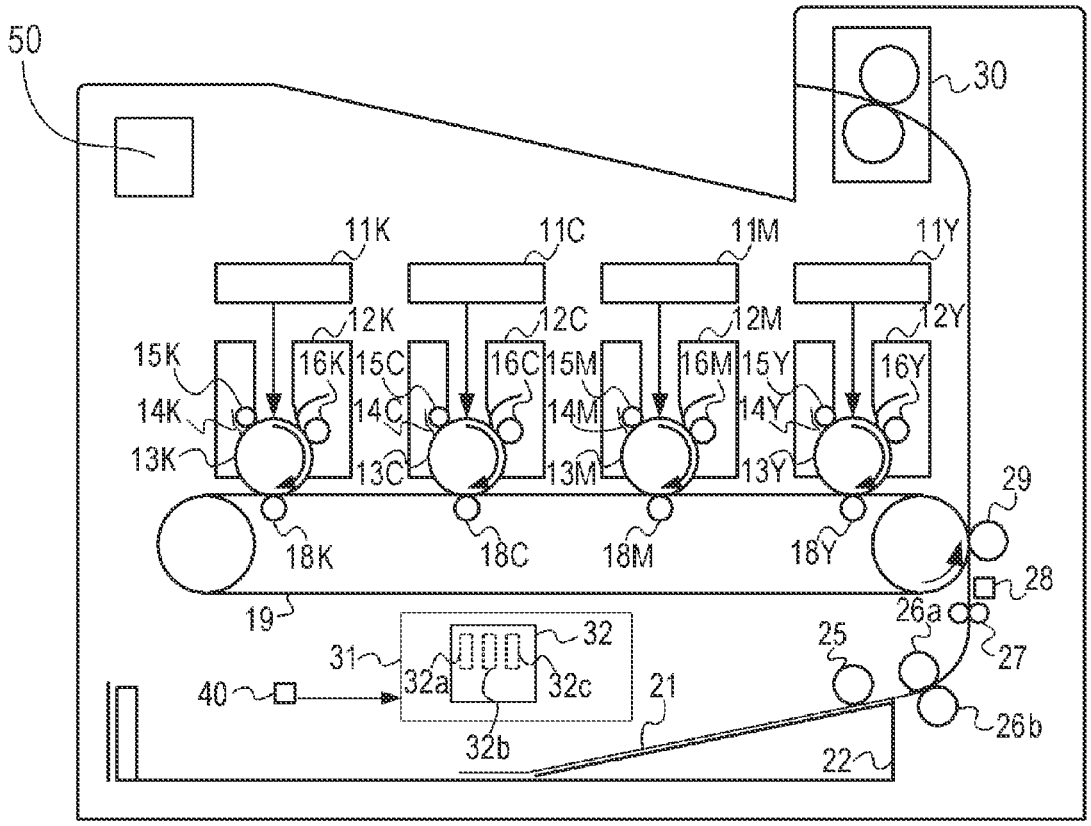
FIG. 1 is a schematic cross-sectional view of an image forming apparatus in Embodiment 1.

FIG. 1 is a configuration diagram of a tandem-type color image forming apparatus which uses an electrophotographic process. By using the drawing, an image forming operation in the configuration of the image forming apparatus will be described. The tandem-type color image forming apparatus is configured to be able to output a full-color image by stacking toners having four colors of yellow (Y), magenta (M), cyan (C), and black (K) on each other.

In order to form images having the individual colors, laser scanners (11Y, 11M, 11C, 11K) and cartridges (12Y, 12M, 12C, 12K) are provided. The cartridges (12Y, 12M, 12C, 12K) are constituted by developing devices having photosensitive members (13Y, 13M, 13C, 13K) which rotate in directions indicated by arrows in the drawing, photosensitive member cleaners (14Y, 14M, 14C, 14K) which are provided so as to be in contact with the photosensitive members, charging rollers (15Y, 15M, 15C, 15K), and developing rollers (16Y, 16M, 16C, 16K).

Further, an intermediate transfer belt 19 is provided to be in contact with the photosensitive members (13Y, 13M, 13C, 13K) for the individual colors, and primary transfer rollers (18Y, 18M, 18C, 18K) are installed so as to face the photosensitive members with the intermediate transfer belt 19 sandwiched therebetween.

The image forming apparatus in the present embodiment has an A motor 101, a B motor, and a C motor. The A motor 101 is a motor for rotating the developing rollers (16Y, 16M, 16C, 16K), and will be described later by using FIG. 2. The B motor which is not shown in the drawing is a motor for rotating the photosensitive members (13Y, 13M, 13C). The C motor which is not shown in the drawing is a motor for rotating the intermediate transfer belt 19 and the photosensitive member 13K. Each of the A motor 101, the B motor, and the C motor is a DC brushless motor, and a combination of the motor and the roller rotated by the motor is not limited to the present embodiment.

A paper feed roller 25, separation rollers 26*a* and 26*b*, and a registration roller 27 are provided downstream of a cassette 22 which stores sheets 21 in a conveying direction, and a conveyance sensor 28 is provided in the vicinity of the registration roller 27 on the downstream side in a sheet conveying direction. Further, a secondary transfer roller 29 is disposed so as to be in contact with the intermediate transfer belt 19 on the downstream side in a conveyance path, and a fixing unit 30 is disposed downstream of the secondary transfer roller 29.

In addition, a controller 31 serving as a control portion of a laser printer is provided, and is constituted by a central processing unit (CPU) 32 including a ROM 32*a*, a RAM 32*b*, and a timer 32*c*, and various input-output control circuits (not shown).

Next, the electrophotographic process will be briefly described. In dark places in the cartridges (12Y, 12M, 12C, 12K), the surfaces of the photosensitive members (13Y, 13M, 13C, 13K) are uniformly charged by the charging rollers (15Y, 15M, 15C, 15K). The driving force of the B motor is transmitted to each of the photosensitive members (13Y, 13M, 13C) by a gear, and the photosensitive members are thereby rotated. Similarly, the driving force of the C motor is transmitted to each of the photosensitive member 13K and the intermediate transfer belt 19 by a gear, and the photosensitive member 13K and the intermediate transfer belt 19 are thereby rotated.

Next, the surfaces of the photosensitive members (13Y, 13M, 13C, 13K) are irradiated with laser light which is modulated according to image data by the laser scanners (11Y, 11M, 11C, 11K). Subsequently, electrification charge in a portion irradiated with the laser light is removed, and electrostatic latent images are thereby formed on the surfaces of the photosensitive members (13Y, 13M, 13C, 13K). In the developing devices, toner is adhered to the electrostatic latent image on each of the photosensitive members (13Y, 13M, 13C, 13K) from each of the developing rollers (16Y, 16M, 16C, 16K) which hold toner layers each having a predetermined amount of toner by a developing bias. With this, toner images having the individual colors are formed on the surfaces of the photosensitive members (13Y, 13M, 13C, 13K).

The toner images formed on the surfaces of the photosensitive members (13Y, 13M, 13C, 13K) are attracted to the intermediate transfer belt 19 at nip portions between the photosensitive members (13Y, 13M, 13C, 13K) and the intermediate transfer belt 19 by a primary transfer bias applied to each of the primary transfer rollers (18Y, 18M, 18C, 18K).

Further, the CPU 32 controls an image formation timing in each of the cartridges (12Y, 12M, 12C, 12K) based on a timing corresponding to a belt conveyance speed to transfer the toner images of the cartridges onto the intermediate transfer belt 19 sequentially. With this, a full-color image is finally formed on the intermediate transfer belt 19.

On the other hand, the sheets 21 in the cassette 22 are conveyed by the paper feed roller 25, only one sheet 21 is caused to pass through the registration roller 27 by the separation rollers 26*a* and 26*b*, and is conveyed to the secondary transfer roller 29. Thereafter, the toner image on the intermediate transfer belt 19 is transferred to the sheet 21 at a nip portion between the secondary transfer roller 29 positioned downstream of the registration roller and the intermediate transfer belt 19, and the toner image on the sheet 21 is finally subjected to heating and fixing processing by the fixing unit 30 and is discharged to the outside of the image forming apparatus. The image forming apparatus in the present embodiment includes an environmental temperature sensor 40 which measures the environmental temperature of outside air, and is capable of performing setting of image formation corresponding to the measured environmental temperature.

Figure 2:
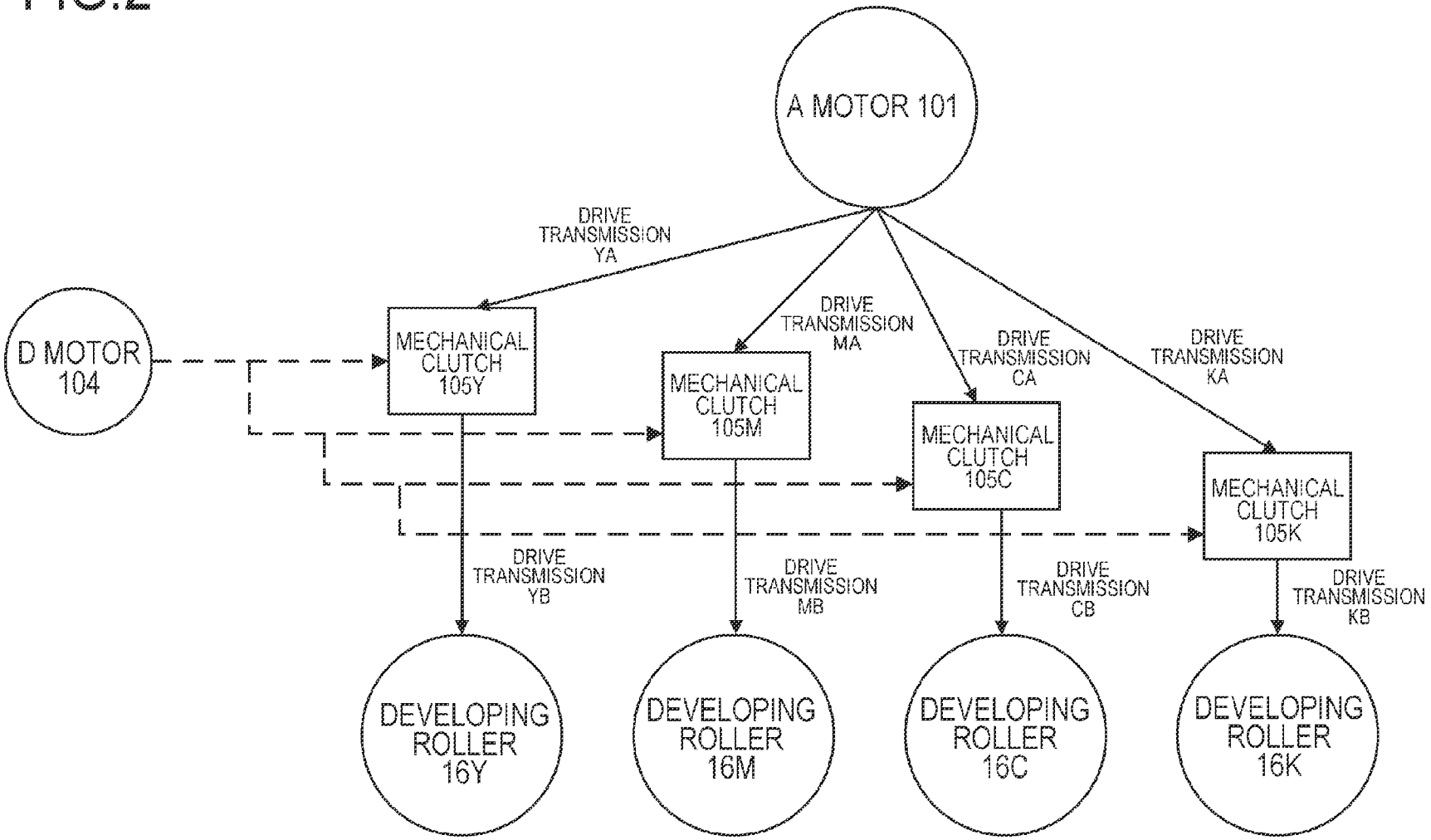
FIG. 2 is a view for explaining a drive configuration of an A motor in Embodiment 1.

Next, by using FIG. 2, a drive configuration for rotating the developing rollers (16Y, 16M, 16C, 16K) will be described. The drive configuration for rotating the developing rollers is constituted by the A motor 101 serving as a single drive source, drive transmission unit (YA, YB, MA, MB, CA, CB, KA, KB) which serve as a drive train and use gear trains, and a D motor 104 and mechanical clutches (105Y, 105M, 105C, 105K) controlled by the D motor 104 which serve as drive switching unit. The drive of the D motor 104 is controlled by the controller 31 (CPU 32).

The A motor 101 is a brushless motor, and a rotational force generated in the A motor 101 is transmitted to each of the mechanical clutches (105Y, 105M, 105C, 105K) at some midpoint in the drive train by the drive transmission unit (YA, MA, CA, KA) which use the gear train. The D motor 104 is a motor capable of rotation position control (e.g., a stepping motor) and, when the D motor is caused to rotate by a predetermined rotation amount, the mechanical clutches are brought into a connection state. Consequently, a rotational driving force transmitted to each of the mechanical clutches (105Y, 105M, 105C, 105K) from the A motor 101 is transmitted to each of the developing rollers (16Y, 16M, 16C, 16K) sequentially via the drive transmission unit (YB, MB, CB, KB) which use the gear train. As a result, the developing rollers (16Y, 16M, 16C, 16K) rotate.

Figure 3:
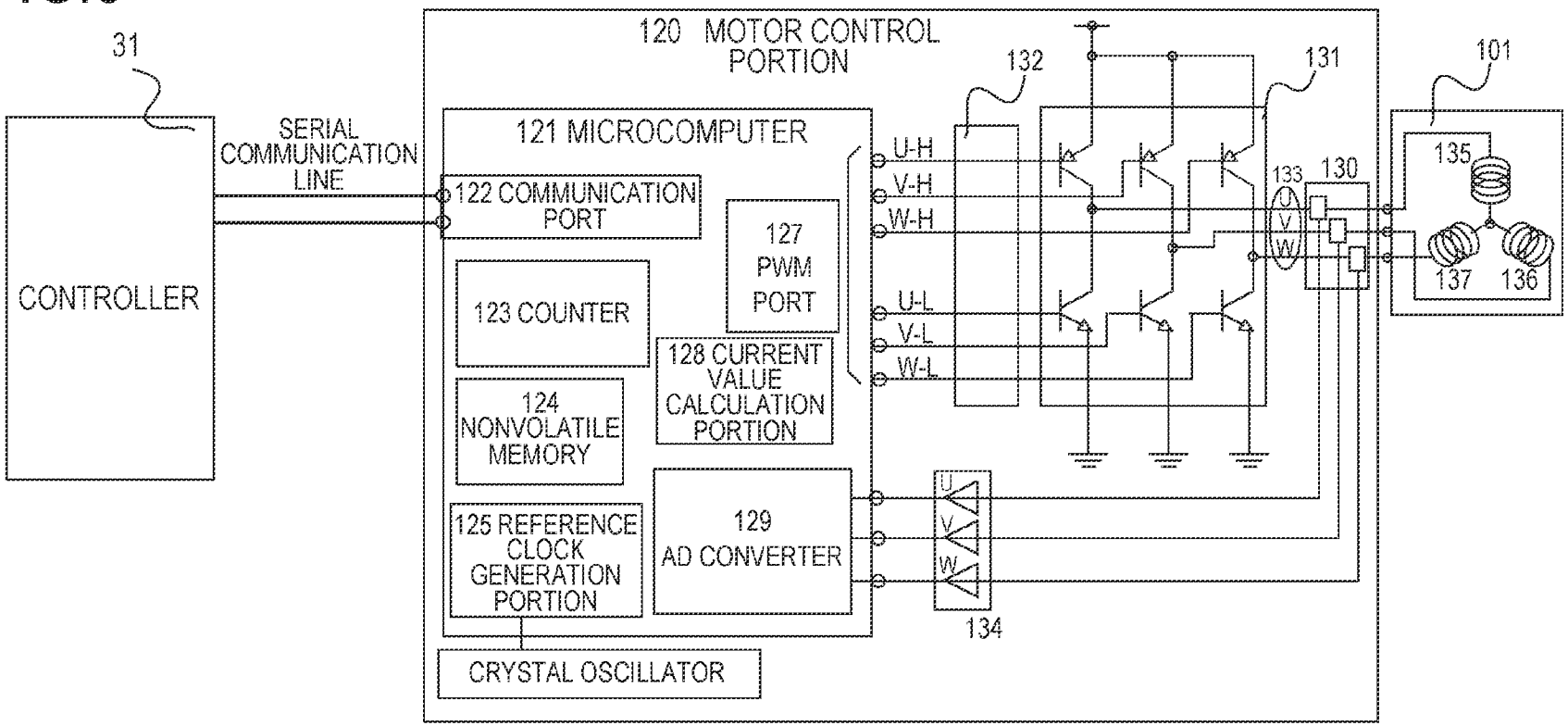
FIG. 3 is a view for explaining a circuit in Embodiment 1.

Next, a motor configuration for causing the A motor 101 to rotate will be described. First, a motor control portion 120 will be described in greater detail. FIG. 3 shows the configuration of the motor control portion 120. The motor control portion 120 is a circuit for causing the A motor 101 to rotate. The motor control portion 120 includes arithmetic processing unit which uses, e.g., a microcomputer 121. The microcomputer 121 includes, in addition to a CPU, a communication port 122, an AD converter 129, a counter 123, a nonvolatile memory 124, a reference clock generation portion 125, a PWM port 127, and a current value calculation portion 128.

The counter 123 performs a count operation based on a reference clock generated by the reference clock generation portion 125, and performs measurement of a period of an input pulse and generation of a PWM signal which is performed in synchronization with the rotation of the A motor 101 by using the count value. The PWM port 127 includes six terminals, and outputs PWM signals of three high-side signal terminals (U-H, V-H, W-H) and three low-side signal terminals (U-L, V-L, W-L).

The motor control portion 120 includes a three-phase inverter 131 constituted by three high-side switching elements and three low-side switching elements. As the switching element, it is possible to use, e.g., a transistor or an FET. Each switching element is connected to the PWM port 127 via a gate driver 132, and it is possible to perform ON/OFF control with the PWM signal output from the PWM port 127. It is assumed that each switching element is turn ON when the PWM signal is H. and is turned OFF when the PWM signal is L.

Outputs 133 of U, V, and W phases of the inverter 131 are connected to coils 135, 136, and 137 of the motor, and it is possible to control energization of coil currents flowing through the coils 135, 136, and 137 with the ON/OFF control of each switching element. The coil currents flowing through the coils 135, 136, and 137 are detected by a current detection portion.

The current detection portion is constituted by a current sensor 130, an amplification portion 134, an AD converter 129, and a current value calculation portion 128. The current value calculation portion 128 is implemented by arithmetic function by the CPU incorporated in the microcomputer, but dedicated hardware capable of current value calculation may also be provided in the microcomputer.

First, the current flowing through the coil is converted to a voltage by the current sensor 130. The voltage is subjected to amplification and application of an offset voltage in the amplification portion 134, and is input to the AD converter 129 of the microcomputer. For example, when it is assumed that the current sensor 130 outputs a voltage of 0.01 V per 1 A, an amplification factor in the amplification portion 134 is 10, and an offset voltage to be applied is 1.6 V, an output voltage of the amplification portion 134 when a current of −10 A to +10 A is caused to flow is 0.6 to 2.6 V.

The AD converter 129 outputs a voltage of e.g., 0 to 3 V as an AD value of 0 to 4095. Consequently, the AD value when a current of −10 A to +10 A is caused to flow is about 819 to 3549. Note that it is assumed that, with regard to the polarity of a current, the current is positive in the case where the current is caused to flow from the three-phase inverter 131 to the A motor 101.

The current value calculation portion 128 performs predetermined arithmetic on data subjected to AD conversion (hereinafter described as an AD value) to calculate the current value. That is, the current value is determined by subtracting an offset value from the AD value and further multiplying the value obtained by the subtraction by a predetermined coefficient. Note that, instead of an actual current value, a value correlated with the actual current value may correspond to the current value calculated herein, and it is described that the current value is determined in the case where such a correlated value is determined. The offset value is the AD value of the offset voltage of 1.6 V, and hence the offset value is about 2184, and the coefficient is about 0.00733. With regard to the offset value, the AD value when the coil current is not caused to flow is read and stored, and is used as the offset value. The coefficient is retained in the nonvolatile memory 124 as a standard coefficient in advance.

By controlling the three-phase inverter 131 via the gate driver 132 with the microcomputer 121, currents flow through the coils 135, 136, and 137 of the A motor 101. The microcomputer 121 detects the currents flowing through the coils with the current sensor 130, the amplification portion 134, and the AD converter 129, and calculates the rotor position and the speed of the A motor 101 from the detected currents flowing through the coils. With the foregoing arrangement, the microcomputer 121 can control the rotation of the A motor 101.

Figure 4:
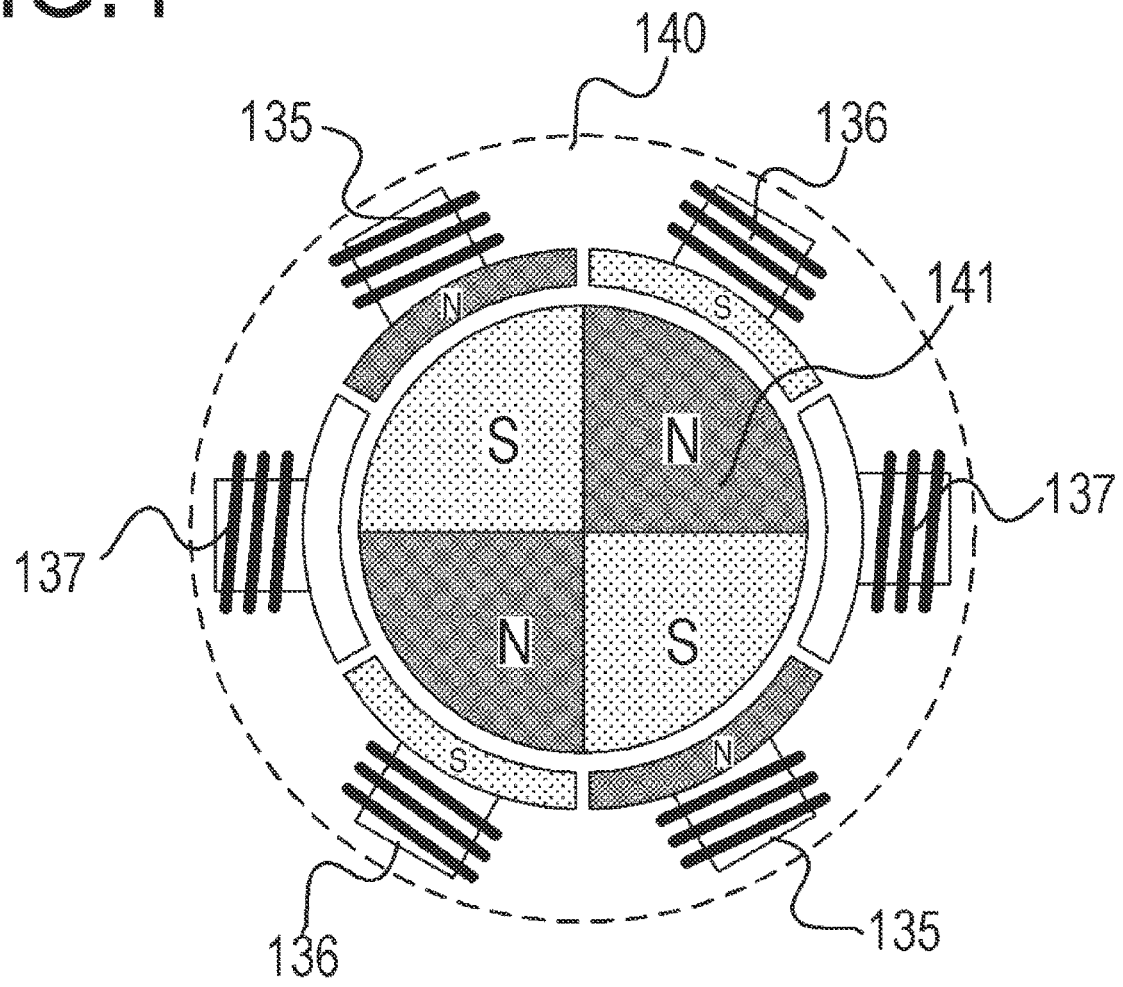
FIG. 4 is a view for explaining a motor structure in Embodiment 1.

Subsequently, the structure of the A motor 101 will be described by using FIG. 4. The A motor 101 is constituted by a six-slot stator 140 and a four-pole rotor 141, and the stator 140 includes the coils 135, 136, and 137 of the U, V, and W phases which are wound around stator cores. The rotor 141 is constituted by a permanent magnet, and includes two sets of the north pole/the south pole. The coils 135, 136, and 137 of U, V, and W layers are connected to inverter outputs.

Figure 5:
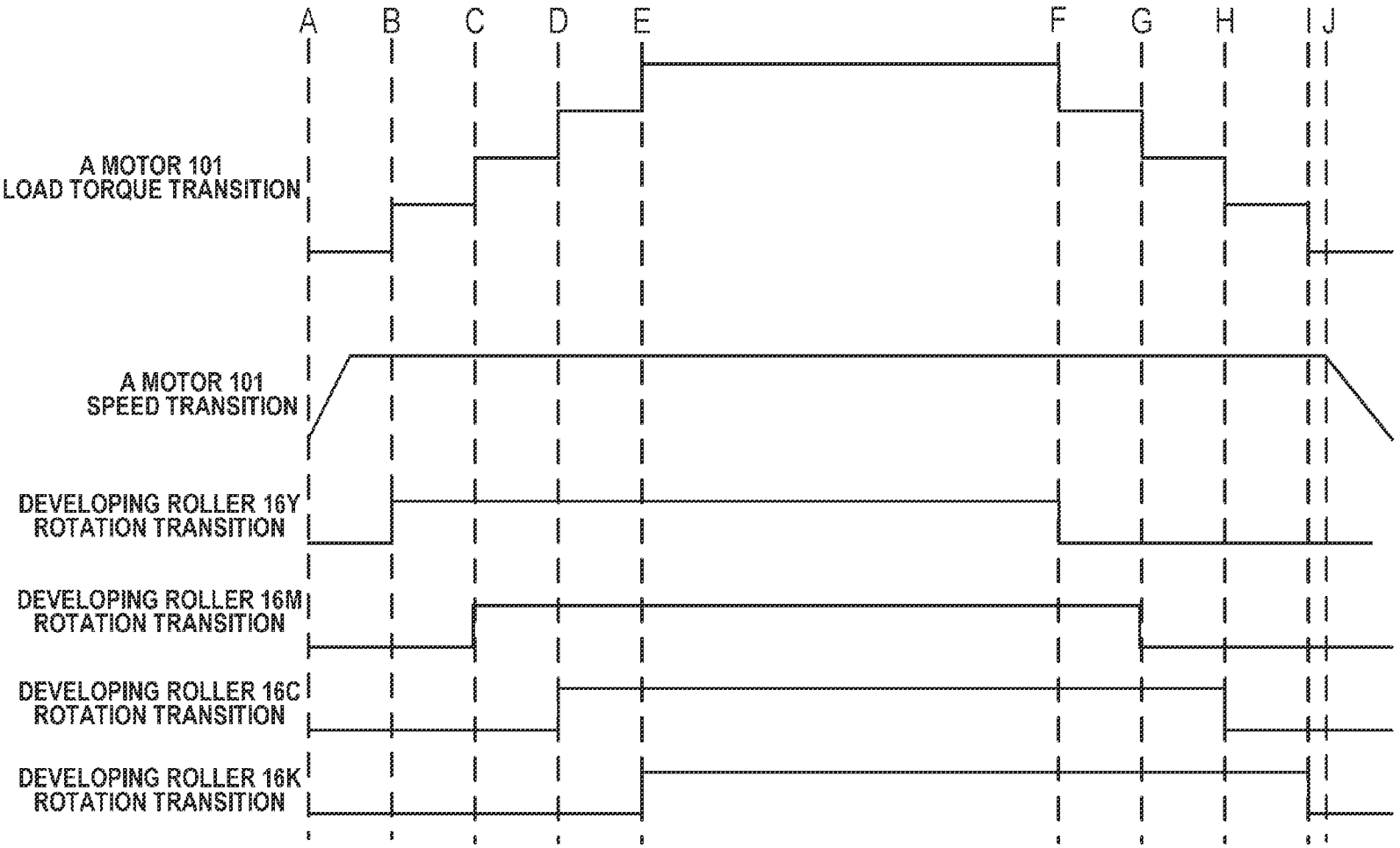
FIG. 5 is a view for explaining a sequence in Embodiment 1.

Subsequently, a description will be given of operations of the A motor 101 which is a characteristic portion in the present embodiment and the developing rollers (16Y, 16M, 16C, 16K) serving as loads of the A motor 101 by using FIG. 5. First, at an A timing, the motor control portion 120 activates the A motor 101 in a disconnection state in which the A motor and the developing rollers (16Y, 16M, 16C, 16K) are not connected.

Subsequently, the controller 31 activates the D motor. With the rotation of the D motor, the mechanical clutch 105Y is connected and the developing roller 16Y starts to rotate at a B timing. The mechanical clutch 105 is constituted by an input portion which receives a driving force from the drive source and an output portion which is connected to a destination to which the driving force is transmitted. When the mechanical clutch 105 is brought into a connection state, the input portion and the output portion are connected mechanically/magnetically, and the driving force input to the input portion is transmitted to the output portion. This state is assumed to be the connection state. Similarly, at C, D. and E timings, the mechanical clutches 105M, 105C, and 105K are connected, whereby the developing rollers 16M, 16C, and 16K start to rotate. A load torque of the A motor 101 is increased successively at the B, C, D, and E timings serving as transmission timings.

After a print job is completed, the controller 31 causes the D motor to rotate and, at F, G, H, and I timings serving as non-transmission timings, the mechanical clutches 105Y, 105M, 105C, and 105K bring the developing rollers into the disconnection state. With this, the rotations of the developing rollers 16Y, 16M, 16C, and 16K successively stop. Finally, the rotation of the A motor 101 is stopped at a J timing.

By having this configuration, even when only one motor is used, it is possible to start and end the rotations of the developing rollers (16Y, 16M, 16C, 16K) immediately before the image formation of each station. Further, it is possible to reduce the rotation amounts of the developing rollers (16Y, 16M, 16C, 16K), and it becomes possible to extend the service life of each of the developing rollers (16Y, 16M, 16C, 16K).

However, the rotation start timing of the A motor 101 is different from the rotation start timings of the developing rollers (16Y, 16M, 16C, 16K). Consequently, it is not possible to accurately calculate the rotation amounts of the developing rollers (16Y, 16M, 16C, 16K) from information relating to the rotation of the A motor 101. Herein, the information relating to the rotation amount of the A motor 101 may be the motor rotation amount of the A motor 101 itself or may also be a rotation time period. In addition, even when the rotation start and rotation stop timings of the developing rollers (16Y, 16M, 16C, 16K) are grasped from a sequence which is prepared in advance and the rotation amounts are predicted, variations are present in the responsivity of a mechanism for switching between connection and disconnection of the developing rollers 16Y, 16M, 16C, and 16K by using the mechanical clutches 105Y, 105M, 105C, and 105K. Therefore, the variations of the mechanism cause an error in the number of rotations of the motor.

In the present embodiment, a description will be given of a method for measuring the rotation amounts of the developing rollers (16Y, 16M, 16C, 16K) without causing the variations of the mechanism by using FIG. 6.

Figure 6:
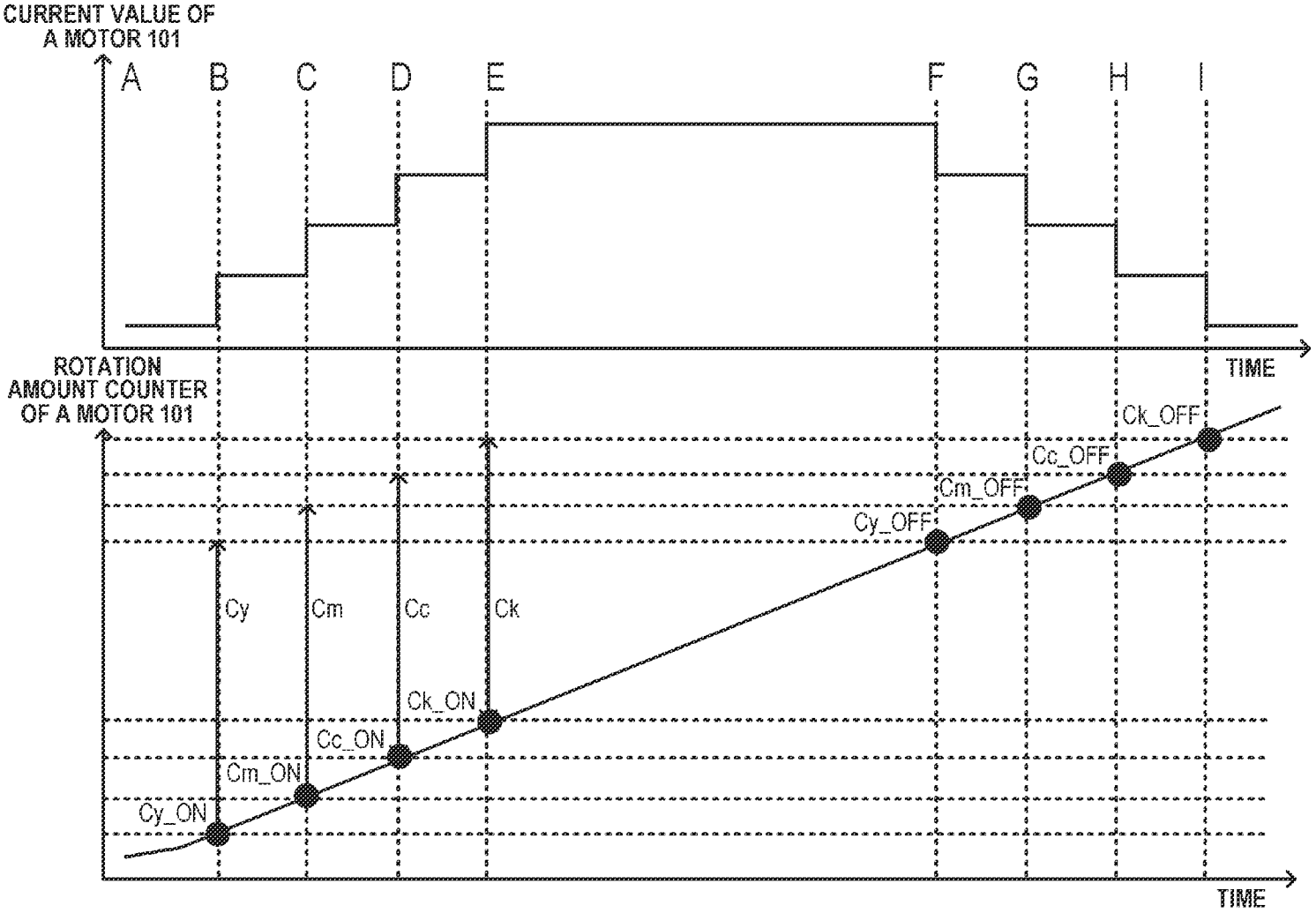
FIG. 6 is a view for explaining control in Embodiment 1.

FIG. 6 represents the current value of the A motor 101 and a rotation amount counter of the A motor 101 with the horizontal axis indicating time. The current value of the current flowing through the A motor 101 can be detected by the current sensor 130, and it is possible to detect torque applied to the A motor 101 and torque change with the current value of the A motor 101. That is, the change of the current value of the A motor 101 shown in FIG. 6 corresponds to load torque transition of the A motor 101 in FIG. 5.

The current value of the A motor 101 changes in a direction in which the current value increases at B, C, D, and E timings (first timings), and changes in a direction in which the current value decreases at F, G, H, and I timings (second timings). The change of the current value of the A motor 101 represents the change of the torque applied to the A motor 101.

The B timing is a timing at which the developing roller 16Y is connected by the mechanical clutch 105Y, and the F timing is a timing at which the developing roller 16Y is disconnected by the mechanical clutch 105Y. The C timing is a timing at which the developing roller 16M is connected by the mechanical clutch 105M, and the G timing is a timing at which the developing roller 16M is disconnected by the mechanical clutch 105M.

The D timing is a timing at which the developing roller 16C is connected by the mechanical clutch 105C, and the H timing is a timing at which the developing roller 16C is disconnected by the mechanical clutch 105C. The E timing is a timing at which the developing roller 16K is connected by the mechanical clutch 105K, and the I timing is a timing at which the developing roller 16K is disconnected by the mechanical clutch 105K.

A rotation amount Cy of the developing roller 16Y is determined by subtracting a rotation amount counter value Cy_ON of the A motor 101 at the B timing from a rotation amount counter value Cy_OFF of the A motor 101 at the F timing and multiplying the value obtained by the subtraction by a ratio of the number of rotations (reduction ratio k) of the developing roller 16Y with respect to the number of rotations of the A motor 101. Hereinafter, the reduction ratio k of the developing roller with respect to the motor denotes the ratio of the number of rotations.

A rotation amount Cm of the developing roller 16M can be determined by subtracting a rotation amount counter value Cm_ON of the A motor 101 at the C timing from a rotation amount counter value Cm_OFF of the A motor 101 at the G timing and multiplying the value obtained by the subtraction by the reduction ratio k. The reduction ratio k at this point is the reduction ratio of the developing roller 16M with respect to the A motor 101.

A rotation amount Cc of the developing roller 16C can be determined by subtracting a rotation amount counter value Cc_ON of the A motor 101 at the D timing from a rotation amount counter value Cc_OFF of the A motor 101 at the H timing and multiplying the value obtained by the subtraction by the reduction ratio k. The reduction ratio k at this point is the reduction ratio of the developing roller 16C with respect to the A motor 101.

A rotation amount Ck of the developing roller 16K can be determined by subtracting a rotation amount counter value Ck_ON of the A motor 101 at the E timing from a rotation amount counter value Ck_OFF of the A motor 101 at the I timing and multiplying the value obtained by the subtraction by the reduction ratio k. The reduction ratio k at this point is the reduction ratio of the developing roller 16K with respect to the A motor 101. With the foregoing arrangement, it becomes possible to accurately calculate the total rotation amount of the developing roller while eliminating a sensor on the developing roller which detects the number of rotations.

Figure 7:
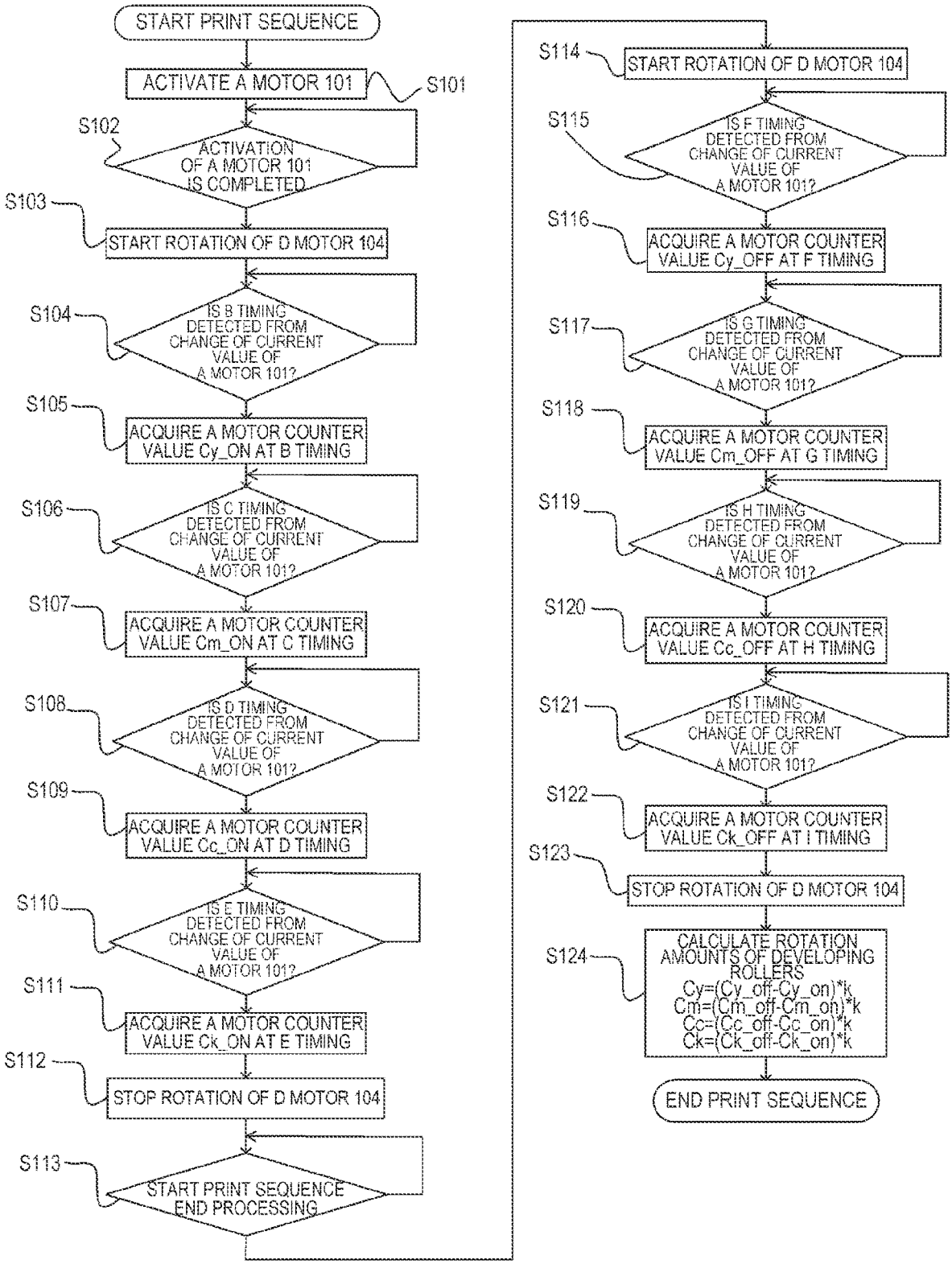
FIG. 7 is a control flowchart in Embodiment 1.

Subsequently, a description will be given of control which explains the present embodiment by using a flowchart in FIG. 7. When a print sequence is started, the CPU 32 instructs the motor control portion 120 to activate the A motor 101 in S101.

Subsequently, the CPU 32 starts the rotation of the D motor 104 in S103 at a timing at which the completion of activation of the A motor 101 is determined in S102. In S104, the CPU 32 detects the B timing at which the developing roller 16Y starts to rotate from the change of the current value of the A motor 101 in the direction in which the current value increases. The B timing at which the current value of the A motor 101 increases is determined by reading detection data from the current detection portion by the CPU 32.

Subsequently, the CPU 32 acquires the rotation amount counter value Cy_ON of the A motor at the B timing in S105. In the present embodiment, the rotor position of the A motor 101 is calculated from the current flowing through the motor, and the rotation amount counter value is counted from the calculated rotor position. However, the same effect can be achieved by disposing a sensor (FG output, Hall element) on the A motor 101, and the operation is not limited to the mode described in the present embodiment.

In S106, the CPU 32 detects the C timing at which the developing roller 16M starts to rotate from the change of the current value of the A motor 101 in the direction in which the current value increases. In addition, in S108, the D timing at which the developing roller 16C starts to rotate is detected from the change of the current value of the A motor 101 in the direction in which the current value increases. Further, in S110, the E timing at which the developing roller 16K starts to rotate is detected from the change of the current value of the A motor 101 in the direction in which the current value increases.

Subsequently, in S107, S109, and S111, the CPU 32 acquires the rotation amount counter value Cm_ON of the A motor at the C timing, the rotation amount counter value Cc_ON of the A motor at the D timing, and the rotation amount counter value Ck_ON of the A motor at the E timing.

Subsequently, the CPU 32 stops the rotation of the D motor 104. With this, the connection state of the mechanical clutch is maintained. The CPU 32 starts the rotation of the D motor 104 in S114 at the timing of start of print sequence end processing in S113. Next, in S115, the CPU 32 detects the F timing at which the developing roller 16Y stops rotating from the change of the current value of the A motor 101 in the direction in which the current value decreases.

Subsequently, in S116, the rotation amount counter value Cy_OFF of the A motor at the F timing is acquired. In S117, S119, and S121, the CPU 32 detects the G timing at which the developing roller 16M stops rotating, the timing H at which the developing roller 16C stops rotating, and the I timing at which the developing roller 16K stops rotating from the timing at which the current value of the A motor 101 changes in the direction in which the current value decreases.

Subsequently, in S118, S120, and S122, the CPU 32 acquires the rotation amount counter value Cm_OFF of the A motor at the G timing, the rotation amount counter value Cc_OFF of the A motor at the H timing, and the rotation amount counter value Ck_OFF of the A motor at the I timing.

Then, in S123, the CPU 32 stops the rotation of the D motor 104. In S124, the print sequence is ended by calculating the rotation amounts of the developing rollers (16Y, 16M, 16C, 16K) by using the following mathematical expressions.

the rotation amount of the developing roller 16*Y*:

$$Cy=(Cy_\mathrm{OFF}-Cy_\mathrm{ON})*k$$

the rotation amount of the developing roller 16*M*:

$$Cm=(Cm_\mathrm{OFF}-Cm_\mathrm{ON})*k$$

the rotation amount of the developing roller 16*C*:

$$Cc=(Cc_\mathrm{OFF}-Cc_\mathrm{ON})*k$$

the rotation amount of the developing roller 16*K*:

$$Ck=(Ck_\mathrm{OFF}-Ck_\mathrm{ON})*k$$

Note that, in the flowchart described above, the CPU 32 serving as acquisition unit acquires the rotation amount of each developing roller, but the acquisition of the rotation amount is not limited thereto. For example, an elapsed time period from the B timing to the F timing, i.e., a time period from the timing at which the developing roller 16Y is connected by the mechanical clutch 105Y until the developing roller 16Y is disconnected may correspond to the rotation amount. This is because the rotation time period of the A motor 101 between connection and disconnection of the mechanical clutch is correlated with the rotation amount of the developing roller. The same applies to the developing rollers for other colors. Then, the CPU 32 can acquire information relating to the rotation amount of the developing roller based on the transmission timing at which the rotational driving force from the A motor 101 is allowed to be transmitted to the developing roller and the non-transmission timing at which the rotational driving force therefrom is prevented from being transmitted.

Then, by adding up the rotation amounts calculated by the present sequence every time the print sequence occurs, it becomes possible to calculate the total rotation amount of the developing roller. By calculating the total rotation amount, it becomes possible to grasp the service life of the developing roller. In the case where the expiration of the service life is grasped, as notification unit, for example, by displaying the expiration of the service life of the developing roller in an operation panel 50, it is possible to notify a user. Control of the notification unit is performed by the CPU 32.

With the foregoing arrangement, it becomes possible to accurately calculate the total rotation amount of the developing roller while eliminating the sensor on the developing roller which detects the number of rotations. Note that, in the present embodiment, the CPU 32 functions as the acquisition unit for calculating and acquiring the rotation amount of the developing roller or the information relating to the rotation amount, but the calculation and acquisition are not limited thereto. That is, as described above, the CPU 32 of the controller 31 may calculate the information relating to the rotation amount of the developing roller based on the value detected by the microcomputer 121. Alternatively, the microcomputer 121 serving as the acquisition unit may calculate and acquire the information relating to the rotation amount of the developing roller, and deliver the calculation result to the controller 31 via a serial communication line. Alternatively, arithmetic performed when the information relating to the rotation amount of the developing roller is calculated may be divided between the microcomputer 121 and the CPU 32.

Embodiment 2

In Embodiment 1 described above, the description has been given of the example in which the rotation start timing and the rotation end timing of the developing roller are detected from the change of the current flowing through the coil of the A motor 101, and the rotation amount of the developing roller is calculated by the means for counting the rotation amount of the A motor 101. In the present embodiment, in a motor having a Hall element on the A motor 101, the rotation start timing and the rotation end timing of the developing roller are detected from the change of the current flowing through the motor. A description will be given of an example in which the rotation amount of the motor is calculated from the rotation time period of the developing roller and the speed of the A motor 101.

Hereinbelow, with regard to the present embodiment, points different from Embodiment 1 will be mainly described, and components common to Embodiment 1 are designated by the same reference numerals and the description thereof will be omitted.

Figure 8:
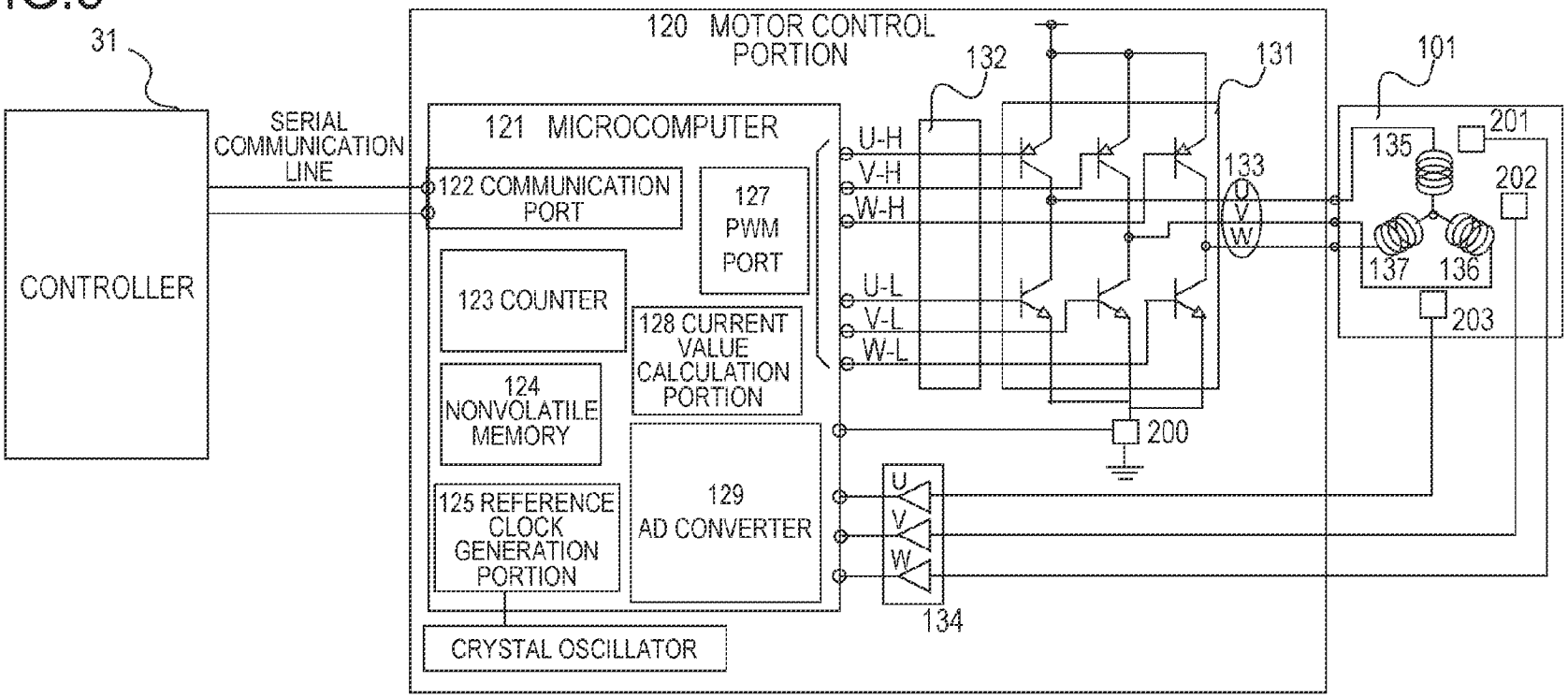
FIG. 8 is a view for explaining a circuit in Embodiment 2.

FIG. 8 shows the configuration of the motor control portion 120. The motor control portion 120 is a circuit for causing the A motor 101 to rotate. The current detection portion is constituted by a current sensor 200, the AD converter 129, and the current value calculation portion 128.

First, a current to the motor is converted to a voltage by the current sensor 200, and the voltage is input to the AD converter 129 of the microcomputer. The current value calculation portion 128 performs predetermined arithmetic on the AD value to calculate the current value. Hall elements 201, 202, and 203 for detecting the rotation of the rotor are provided on the A motor 101, and a voltage output by the Hall element is input to the microcomputer 121 after being amplified by the amplification portion 134.

The microcomputer 121 calculates the rotor position and the speed of the A motor 101 with the Hall elements 201, 202, and 203, the amplification portion 134, and the AD converter 129 which serve as rotation speed acquisition unit. The microcomputer 121 controls the three-phase inverter 131 via the gate driver 132 based on rotor position information detected by the Hall elements 201, 202, and 203. Then, currents flow through the coils 135, 136, and 137 of the A motor 101, and the A motor 101 is thereby caused to rotate. With the foregoing arrangement, the microcomputer 121 can control the rotation of the A motor 101.

Figure 9:
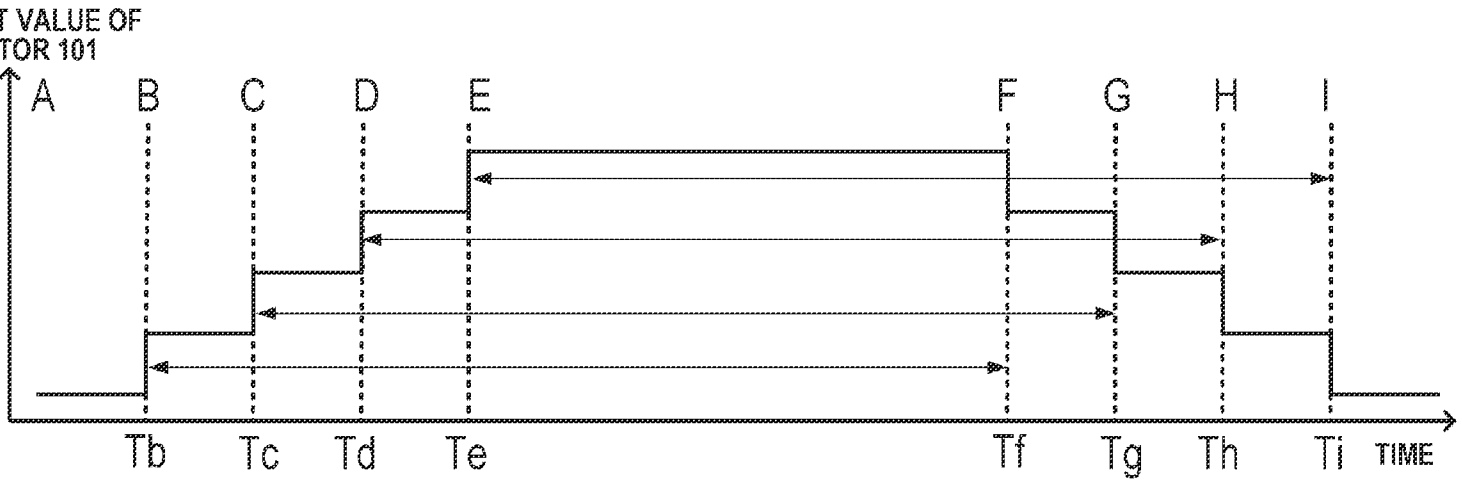
FIG. 9 is a view for explaining control in Embodiment 2.

In FIG. 9, the horizontal axis indicates time and the vertical axis indicates the current value of the A motor 101. It is assumed that a B timing, a C timing, a D timing, and an E timing are timings at which the developing rollers (16Y, 16M, 16C, 16K) start to rotate, and times at these timings are Tb, Tc, Td, and Te. It is assumed that an F timing, a G timing, an H timing, and an I timing are timings at which the developing rollers (16Y, 16M, 16C, 16K) stop rotating, and times at these timings are Tf, Tg, Th, and Ti.

With the foregoing arrangement, the rotation time periods of the developing rollers (16Y, 16M, 16C, 16K) can be determined by the following mathematical expressions.

the rotation time period $Ty$ of the developing roller 16$Y$=$Tf-Tb$ the rotation time period $Tm$ of the developing roller 16$M$=$Tg-Tc$ the rotation time period $Tc$ of the developing roller 16$C$=$Th-Td$ the rotation time period $Tk$ of the developing roller 16$K$=$Ti-Te$ It is possible to calculate the rotation amounts of the developing rollers by multiplying the rotation time periods of the developing rollers by the rotation speed V of the motor and the reduction ratios k of the developing rollers (16Y, 16M, 16C, 16K) with respect to the A motor 101. With the foregoing arrangement, it becomes possible to accurately calculate the total rotation amount of the developing roller while eliminating the sensor on the developing roller which detects the number of rotations.

Figure 10:
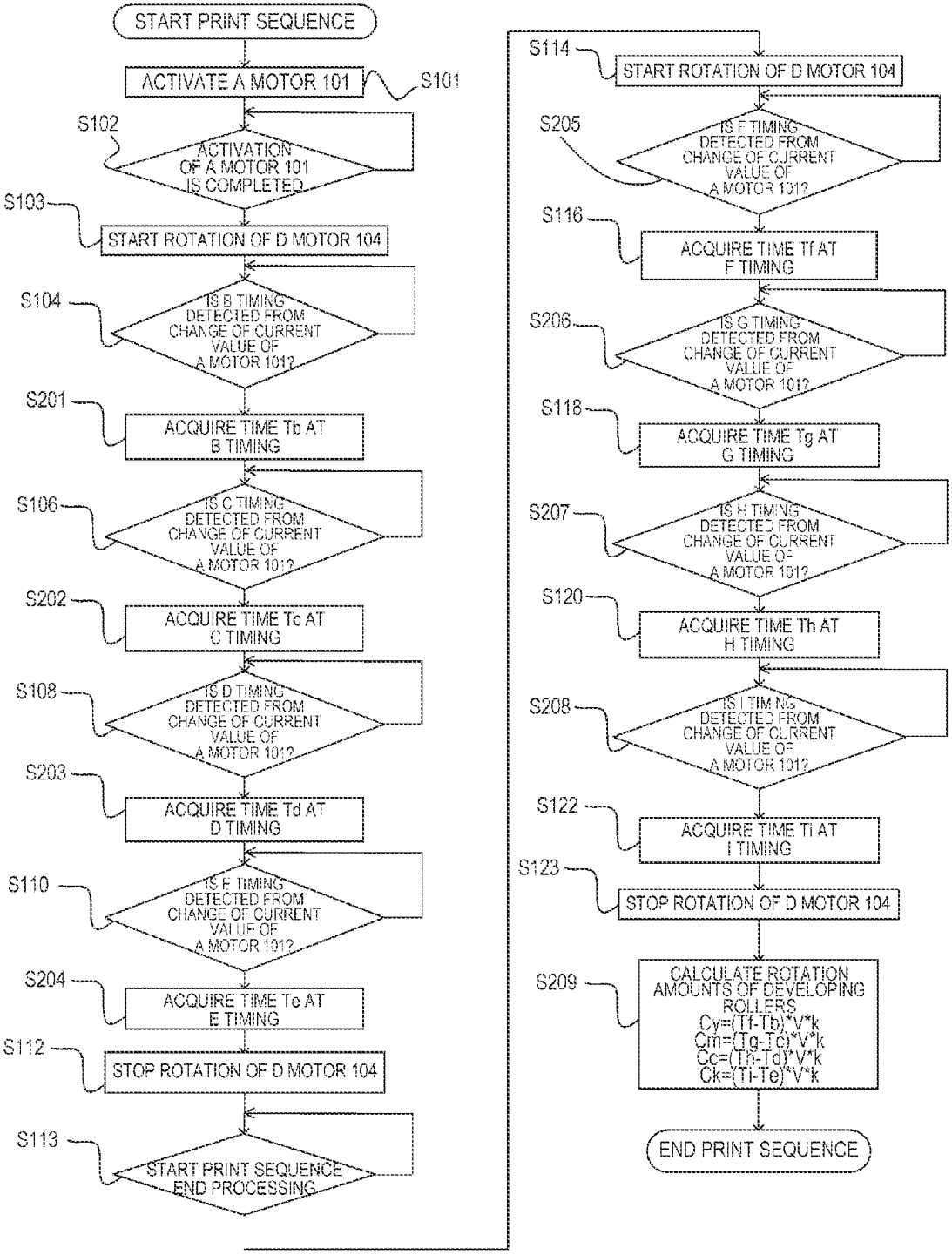
FIG. 10 is a control flowchart in Embodiment 2.

Subsequently, a description will be given of control which explains the present embodiment by using a flowchart in FIG. 10. When the print sequence is started and the CPU 32 activates the A motor 101 in S101 and S102, the CPU 32 starts the rotation of the D motor 104 in S103. In S201, S202, S203, and S204, the CPU 32 acquires the times Tb, Tc, Te, and Tf at the B timing, the C timing, the D timing, and the E timing which are timings at which the developing rollers (16Y, 16M, 16C, 16K) start to rotate.

The CPU 32 starts end processing of the print sequence in S113, and starts the rotation of the D motor 104 in S114. In S205, S206, S207, and S208, the CPU 32 acquires the times Tf, Tg, Th, and Ti at the F timing, the G timing, the H timing, and the I timing which are timings at which the developing rollers (16Y, 16M, 16C, 16K) stop rotating.

Then, in S123, the CPU 32 stops the rotation of the D motor 104. In S209, the print sequence is ended by calculating the rotation amounts of the developing rollers (16Y, 16M, 16C, 16K) by using the following mathematical expressions.

the rotation amount of the developing roller 16$Y$:
$Cy=(Tf-Tb)*V*k$ the rotation amount of the developing roller 16$M$:
$Cm=(Tg-Tc)*V*k$ the rotation amount of the developing roller 16$C$:
$Cc=(Th-Td)*V*k$ the rotation amount of the developing roller 16$K$:
$Ck=(Ti-Te)*V*k$ By adding up the rotation amounts calculated by the present sequence every time the print sequence occurs, it becomes possible to calculate the total rotation amount of the developing roller. By calculating the total rotation amount, it becomes possible to grasp the service life of the developing roller.

With the foregoing arrangement, it becomes possible to accurately calculate the total rotation amount of the developing roller while eliminating the sensor on the developing roller which detects the number of rotations. Note that, also in the present embodiment, similar to Embodiment 1, the CPU 32 functions as the acquisition unit for calculating and acquiring the rotation amount of the developing roller, but the acquisition and calculation are not limited thereto. That is, as described above, the CPU 32 of the controller 31 may calculate the rotation amount of the developing roller based on the value detected by the microcomputer 121. Alternatively, the microcomputer 121 serving as the acquisition unit may calculate and acquire the rotation amount of the developing roller, and deliver the calculation result to the controller 31 via the serial communication line. Alternatively, arithmetic performed when the rotation amount of the developing roller is calculated may be divided between the microcomputer 121 and the CPU 32.

In the present embodiment, the tandem-type image forming apparatus having a plurality of developing rollers is described as an example, but it will be appreciated that the present invention can be applied to a monochrome image forming apparatus having one developing roller. In addition, in the present embodiment, the change of the torque is detected from the change of the current of the brushless motor, and the timing at which the driving force of the brushless motor is allowed to be transmitted by the drive transmission switching unit and the timing at which the driving force thereof is prevented from being transmitted by the drive transmission switching unit are detected. In a stepping motor or a brush motor, when a configuration is adopted in which the number of rotations is detected and is fed back to the current flowing through the motor, it is possible detect the change of the torque by detecting the current. Accordingly, the present invention can also be used in the stepping motor or the brush motor.

It becomes possible to save space and reduce cost by eliminating the sensor which detects the rotation of the developing roller and, at the same time, accurately estimate the rotation amount of the developing roller or the information corresponding to the rotation amount thereof with higher accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-095729, filed on Jun. 1, 2020, which is hereby incorporated by reference herein in its entirety.

What is claimed is:

1. An image forming apparatus comprising:

a developing roller;

a motor;

a motor control portion configured to control the motor;

a drive train configured to transmit a rotational driving force of the motor to the developing roller;

a drive switching unit configured to switch between transmission and non-transmission of the rotational driving force of the motor relative to the developing roller by the drive train;

a current detection portion configured to detect a current value of a current flowing through the motor; and an acquisition unit configured to acquire information relating to a rotation amount of the developing roller, wherein the acquisition unit is configured to acquire the information relating to the rotation amount of the developing roller on the basis of (i) a transmission timing at which the rotational driving force is allowed to be transmitted to the developing roller by the drive switching unit and (ii) a non-transmission timing at which the rotational driving force is prevented from being transmitting to the developing roller by the drive switching unit, wherein the transmission timing and the non-transmission timing are acquired from a change of the current value detected by the current detection portion.

2. The image forming apparatus according to claim 1, wherein the acquisition unit is configured to acquire information relating to a rotation amount of the motor, wherein the acquisition unit is configured to acquire the information relating to the rotation amount of the developing roller on the basis of the information relating to the rotation amount of the motor acquired by the acquisition unit at the transmission timing and the information relating to the rotation amount of the motor acquired by the acquisition unit at the non-transmission timing.

3. The image forming apparatus according to claim 2, wherein the motor has a stator having a stator core and a coil wound around the stator core, and a rotor including a permanent magnet, wherein the motor control portion has a switching element configured to control energization of the coil, and output unit configured to output a pulse for controlling ON/OFF of the switching element, and wherein the acquisition unit is configured to count a pulse generated in synchronization with rotation of the motor.

4. The image forming apparatus according to claim 3, wherein the acquisition unit is configured to count a value correlated with the rotation amount of the motor on the basis of a position of the rotor which is acquired based on the current value detected by the current detection portion.

5. The image forming apparatus according to claim 1, further comprising speed acquisition unit configured to acquire a rotation speed of the motor, wherein the acquisition unit is configured to acquire the information relating to the rotation amount of the developing roller on the basis of a rotation time period of the developing roller acquired from a time period from the transmission timing to the non-transmission timing and the rotation speed acquired by the speed acquisition unit.

6. The image forming apparatus according to claim 5, wherein the motor has a stator having a stator core and a coil wound around the stator core, and a rotor including a permanent magnet, wherein the motor control portion has a switching element configured to control energization of the coil, and output unit configured to output a pulse for controlling ON/OFF of the switching element, and wherein the speed acquisition unit has a Hall element configured to detect a speed of the rotor.

7. The image forming apparatus according to claim 1, further comprising a plurality of the developing rollers, wherein the motor is a single drive source for the plurality of the developing rollers.

8. The image forming apparatus according to claim 7, wherein the drive switching unit is configured to implement switching between the transmission and the non-transmission such that the transmission timing and the non-transmission timing of each of the plurality of the developing rollers differ from each other, and wherein the acquisition unit is configured to acquire information relating to a rotation amount of each of the plurality of the developing rollers by using reduction ratios of the plurality of the developing rollers.

9. The image forming apparatus according to claim 1, further comprising notification unit configured to provide notification of expiration of service life of the developing roller on the basis of the information relating to the rotation amount of the developing roller acquired by the acquisition unit.

10. The image forming apparatus according to claim 1, wherein the drive switching unit has a clutch provided at an intermediate point in the drive train and a stepping motor which controls the clutch.

11. An image forming apparatus comprising:

a developing roller;

a motor;

a motor control portion configured to control the motor;

a drive train configured to transmit a rotational driving force of the motor to the developing roller;

a drive switching unit configured to switch between transmission and non-transmission of the rotational driving force of the motor relative to the developing roller by the drive train;

a current detection portion configured to detect a current value of a current flowing through the motor; and an acquisition unit configured to acquire information relating to a rotation amount of the developing roller, wherein the acquisition unit is configured to acquire the information relating to the rotation amount of the developing roller on the basis of (i) first information relating to a rotation of the motor acquired at a first timing and (ii) second information relating to the rotation of the motor acquired at a second timing, wherein the acquisition unit is configured to determine the first timing and the second timing on the basis of a change of the current value detected by the current detection portion.

12. The image forming apparatus according to claim 11, wherein the first timing is a timing at which the current value detected by the current detection portion increases, the second timing is a timing at which the current value detected by the current detection portion decreases.

13. The image forming apparatus according to claim 11, wherein the first information and the second information include information relating to at least one of (i) a rotation amount of the motor, (ii) a rotation speed of the motor, and (iii) a rotation time of the motor.

14. The image forming apparatus according to claim 11, wherein the first timing is a timing at which the rotational driving force is allowed to be transmitted to the developing roller by the drive switching unit, and the second timing is a timing at which the rotational driving force is prevented from being transmitting to the developing roller by the drive switching unit.

15. The image forming apparatus according to claim 11, further comprising a plurality of the developing rollers, wherein the motor is a single drive source for the plurality of the developing rollers.

* * * * *